US008468725B2

(12) United States Patent
Leslie et al.

(10) Patent No.: US 8,468,725 B2
(45) Date of Patent: Jun. 25, 2013

(54) MOUNTING PIN ASSEMBLY FOR AN EXCAVATOR WEAR MEMBER

(75) Inventors: Bruce Alexander Leslie, Goodna (AU); Simon Peter Orton, Highland Park (AU); Todd John Lawler, Taringa (AU); Paul Lindsay Heaphy, Stafford (AU)

(73) Assignee: CQMS Pty Ltd, Queensland (AU)

( * ) Notice: Subject to any disclaimer, the term of this patent is extended or adjusted under 35 U.S.C. 154(b) by 140 days.

(21) Appl. No.: 12/593,952

(22) PCT Filed: Feb. 29, 2008

(86) PCT No.: PCT/AU2008/000269

§ 371 (c)(1),
(2), (4) Date: Mar. 8, 2010

(87) PCT Pub. No.: WO2008/119103

PCT Pub. Date: Oct. 9, 2008

(65) Prior Publication Data

US 2010/0229433 A1 Sep. 16, 2010

(30) Foreign Application Priority Data

Apr. 3, 2007 (AU) ..... 2007901765

(51) Int. Cl.
*E02F 9/28* (2006.01)

(52) U.S. Cl.
USPC ..... 37/456; 172/722

(58) Field of Classification Search
USPC ..... 37/455, 456, 449, 450, 451, 452, 37/453, 454, 457, 458, 459; 172/722, 722.5
See application file for complete search history.

(56) References Cited

U.S. PATENT DOCUMENTS

| | | | | |
|---|---|---|---|---|
| 943,775 | A * | 12/1909 | Exton et al. | 37/454 |
| 3,774,324 | A | 11/1973 | Lanfond | |
| 3,839,805 | A | 10/1974 | Stepe | |
| 3,982,339 | A | 9/1976 | Nilsson | |
| 4,182,058 | A | 1/1980 | Poncin | |

(Continued)

FOREIGN PATENT DOCUMENTS

| | | |
|---|---|---|
| AU | 716828 B2 | 6/1997 |
| AU | 2003264586 | 7/2004 |
| CA | 2161505 | 4/1997 |
| WO | 00/20696 A1 | 4/2000 |

OTHER PUBLICATIONS

International Search Report from PCT/AU2008/000269 dated Mar. 17, 2008.

*Primary Examiner* — Jamie L McGowan
(74) *Attorney, Agent, or Firm* — Wong, Cabello, Lutsch, Rutherford & Brucculeri LLP

(57) ABSTRACT

A mounting pin assembly having a retaining member which includes a locating surface and a boss extending from the locating surface. The mounting pin assembly also has a locating member slidably mountable upon the locating surface of the retaining member. The locating member also has an enlarged portion defined by an outwardly divergent face. The mounting pin assembly also has a tensioning member extending between and coupling the boss of said retaining member and the locating member. The tensioning member is configured to cause relative contraction of the mounting pin assembly such that the locating member is drawn upon the locating surface of the retaining member towards the boss when a tensile force is applied to the tensioning member.

15 Claims, 6 Drawing Sheets

U.S. PATENT DOCUMENTS

| | | | | | |
|---|---|---|---|---|---|
| 4,231,173 | A | | 11/1980 | Davis | |
| 4,233,761 | A | | 11/1980 | Ryerson | |
| 4,338,736 | A | | 7/1982 | Radigan | |
| 4,404,760 | A | | 9/1983 | Hahn et al. | |
| 4,481,728 | A | | 11/1984 | Mulder et al. | |
| 4,587,751 | A | | 5/1986 | Sjogren et al. | |
| 4,903,420 | A | | 2/1990 | Kreitzberg et al. | |
| 5,088,214 | A | | 2/1992 | Jones | |
| 5,172,501 | A | | 12/1992 | Pippins | |
| 5,272,824 | A | | 12/1993 | Cornelius | |
| 5,337,495 | A | | 8/1994 | Pippins | |
| 5,410,826 | A | * | 5/1995 | Immel et al. | 37/457 |
| 5,423,138 | A | | 6/1995 | Livesay et al. | |
| 5,452,529 | A | * | 9/1995 | Neuenfeldt et al. | 37/455 |
| 5,469,648 | A | | 11/1995 | Jones et al. | |
| 5,564,206 | A | * | 10/1996 | Ruvang | 37/458 |
| 5,617,655 | A | * | 4/1997 | Launder et al. | 37/457 |
| 5,638,621 | A | * | 6/1997 | Keech et al. | 37/446 |
| 5,653,048 | A | | 8/1997 | Jones et al. | |
| 5,709,043 | A | | 1/1998 | Jones | |
| 5,784,813 | A | | 7/1998 | Balassa et al. | |
| 5,868,518 | A | | 2/1999 | Chesterfield et al. | |
| 5,937,550 | A | | 8/1999 | Emrich | |
| 6,009,644 | A | * | 1/2000 | Hedley | 37/456 |
| 6,018,896 | A | | 2/2000 | Adamic | |
| 6,052,927 | A | | 4/2000 | Pippins | |
| 6,119,378 | A | | 9/2000 | Pippins | |
| 6,467,203 | B2 | | 10/2002 | Pippins | |
| 6,467,204 | B1 | | 10/2002 | Creighton et al. | |
| 6,735,890 | B2 | | 5/2004 | Carpenter et al. | |
| 7,100,315 | B2 | | 9/2006 | Carpenter et al. | |
| 7,313,877 | B2 | * | 1/2008 | Clendenning et al. | 37/456 |
| 7,603,799 | B2 | * | 10/2009 | Campomanes | 37/456 |
| 7,681,341 | B2 | * | 3/2010 | Ruvang | 37/456 |
| 7,690,137 | B2 | * | 4/2010 | Pasqualini | 37/455 |
| RE41,855 | E | * | 10/2010 | Ruvang et al. | 37/456 |
| D634,605 | S | * | 3/2011 | Guimaraes | D8/343 |
| 2002/0000053 | A1 | | 1/2002 | Adamic | |

* cited by examiner

MOUNTING PIN ASSEMBLY FOR AN EXCAVATOR WEAR MEMBER

CROSS REFERENCE TO RELATED APPLICATION

The present application is a National Stage entry from PCT Patent Application No. PCT/AU2008/000269 filed on 29 Feb. 2008, which claims priority to Australian Application 2007901765 filed on 3 Apr. 2007 the contents of each one incorporated herein by reference.

FIELD OF THE INVENTION

The invention relates to a mounting pin assembly for an excavator wear member. In particular, although not exclusively, the invention relates to a mounting pin for mounting a wear member on a nose structure located on a lip of an excavator bucket.

BACKGROUND OF THE INVENTION

Excavator tooth assemblies mounted to the digging edge of excavator buckets and the like generally comprise a replaceable digging point, an adaptor body and an adaptor nose which is secured by welding or the like to the digging edge of a bucket or the like. The adaptor has a socket-like recess at its rear end to receivably locate a front spigot portion of the adaptor nose and a removable locking pin extends through aligned apertures in the adaptor and nose to retain the adaptor in position.

In use, excavator teeth are subjected to extensive load forces along a longitudinal axis of a tooth as well as in vertical and transverse directions. A snug fit is required between the digging point and the front portion of the adaptor and also between the adaptor socket and the nose spigot portion and their respective mounting pins to avoid premature wear between the components. As the various components wear, the locking pins can loosen thereby increasing the risk of loss of a digging point or an entire adaptor/tooth combination. This necessitates considerable downtime to replace the lost wear members and where items such as locking pins are not recovered, these can cause damage and/or further downtime in downstream operations such as ore crushing and the like.

The greatest loads experienced by excavator tooth assemblies are vertical loads which tend to generate large moment forces capable of rotating a tooth off the front of an adaptor and/or rotating the adaptor off the adaptor nose. In addition, twisting or "yaw" loads are frequently imposed on such tooth assemblies.

Despite many prior art attempts to improve the mounting of an adaptor to a nose, most of these proposals suffer from one or more deficiencies. As described hereinafter, many of the prior art references relate to direct mounting of a tooth onto an adaptor without an intermediate adaptor but in those assemblies, the mounting systems for securing teeth directly onto excavator noses is considered analogous to the mounting of an adaptor onto a nose.

U.S. Pat. No. 4,182,058 describes an excavator tooth having a rearwardly divergent tapering socket to receive a nose having a complementary-shaped front spigot portion. Resistance to rotational moment forces is borne by a resilient steel cotter pin extending through aligned vertical apertures in the socket and spigot portions.

U.S. Pat. Nos. 3,774,324, 4,338,736, 4,481,728, 4,903,420, 5,469,648, 7,100,315 and 6,735,890 all describe nose and tooth combinations wherein the nose has a generally convergently tapering spigot portion with a forward tip having a box-like configuration with at least the upper and lower surfaces thereof having faces parallel to each other and to a longitudinal axis of the nose portion. With the exception of U.S. Pat. No. 4,338,736, which describes a transverse locking pin, each of the tooth mounting arrangements is heavily reliant on a large vertical locking pin to resist rotational moment forces tending to rotate the teeth off respective noses.

U.S. Pat. No. 4,231,173 describes a tapered adaptor nose having a box-like free end, which engages in a mating box-like socket cavity to resist rotational moments. Opposed pairs of rearwardly extending tongues engage in corresponding recesses in the outer surfaces of the adaptor nose to resist rotational movements. Because the tongues themselves are unsupported, they possess a limited capacity to resist rotational moment forces.

U.S. Pat. No. 5,272,824 describes a structure similar to that of U.S. Pat. No. 4,231,173 except that the side tongues are of more robust dimensions and the upper and lower tongues are formed as box-like members with apertures to receive a vertical mounting pin passing through aligned apertures in the tooth and adaptor nose.

U.S. Pat. No. 4,404,760 provides flat rail surfaces on the adaptor nose to engage with mating grooves in the socket aperture of a corresponding tooth wherein the mating rail and groove surfaces are generally parallel to the longitudinal axis of the tooth.

U.S. Pat. No. 5,423,138 describes a generally tapered nose having a box-like front end with upper and lower transverse surfaces generally parallel to a longitudinal axis of a tooth which located directly thereon. The parallel upper and lower transverse surfaces are contiguous with upper and lower rail surfaces on each side of the nose and parallel to the longitudinal axis of the tooth. A pair of rearwardly extending side tongues locate in recesses formed in the outer side faces of the nose, ostensibly to resist rotational moment forces in the tooth. Because the side tongues are recessed to accommodate the side rail portions, the robustness of the side tongues is somewhat compromised.

U.S. Pat. No. 4,233,761 describes a fairly stubby tapered nose having a box-like front portion with upper and lower surfaces generally parallel to a longitudinal axis of an excavator tooth, an intermediate rearwardly diverging tapered portion and a rear portion having upper and lower surfaces extending generally parallel to a longitudinal axis of the tooth. Formed on the upper and lower surfaces of the front, intermediate and rear portions of the nose are spaced parallel reinforcing ribs which are located in mating grooves in the excavator tooth. A large vertical locking pin extends through aligned apertures in the tooth and nose between the reinforcing ribs. This structure is heavily reliant on the locking pin to resist rotational moment forces however it is considered that this configuration may be prone to failure in the rear portion of the adaptor.

U.S. Pat. No. 5,709,043 describes a nose/adaptor combination wherein the adaptor socket tapers convergently towards a box-like front portion having upper and lower bearing surfaces generally parallel to a longitudinal axis of the tooth, a front transverse upright bearing surface and rearwardly divergent bearing surfaces formed at obtuse angles between the converging upper and lower walls and the side walls of the socket, ostensibly to avoid areas of stress concentration.

U.S. Pat. No. 6,018,896 describes a pin/retainer system for locking an excavation tooth onto an adaptor wherein the retainer is inserted in the adaptor and a wedge-shaped pin is driven into aligned apertures in the tooth and adaptor to resiliently engage with the retainer.

United States Publication No US 2002/0000053A1 describes a mechanism for releasably retaining an adaptor into the nose of a bucket lip or the like wherein a tapered threaded socket is non-rotatably located on the inside of an aperture in the side wall of the adaptor. A threaded retaining pin extends through the threaded socket and locates in an aligned aperture in the bucket nose.

U.S. Pat. No. 5,337,495 describes a tooth assembly with a two-piece telescopically engageable adaptor secured to a nose with a tapered wedge pin assembly. A similar mounting system is described in U.S. Pat. No. 5,172,501 and U.S. Pat. No. 6,052,927. Other retention systems for digging points on adaptors or adaptors on noses are described in U.S. Pat. Nos. 6,119,378, 6,467,204, and 6,467,203.

Other devices for removably securing replaceable wear elements on earth working equipment such as a retaining pin, a bolt, a pin lock and locking blocks engageable in a top aperture in a wear member are described in U.S. Pat. Nos. 3,839,805, 3,982,339, 4,587,751, 5,088,214 and 5,653,048 respectively.

U.S. Pat. No. 5,937,550 describes a lock assembly for releasably securing an adaptor to a nose of an excavator support structure. The lock assembly comprises a body and a base coupled together and adapted for insertion, while coupled together, in a hole in the nose of the support structure. The length of the lock assembly is extended to secure the adaptor and is retracted to release the adaptor. While adequate for securing an adaptor to a nose of an excavator support structure, the lock described in this patent is relatively complex in design and operation leading to high costs and labour intensive extraction procedures in the field.

Canadian Patent Application No 2,161,505 describes a system for removably retaining an excavation point on an adaptor with at least one flanged sleeve having a screw-threaded aperture therein, the flanged sleeve being non-rotatably locatable in a transverse bore in the adaptor before fitment of the point onto the adaptor. A screw-threaded pin is inserted into the sleeve via an aperture in the point whereby portion of the head of the pin retains the point on the adaptor.

Australian Patent Application No 2003264586 describes a locking pin assembly comprising a body member having a non-circular cross-sectional shape locatable in a bore of complementary shape extending laterally between opposite sides of an excavator lip mounting nose. After locating the body member in the nose aperture, an adaptor can be engaged over the nose with apertures in opposite side walls aligned with the body member. Threaded bolts engage in threaded apertures in opposite ends of the body member, the bolts each having a tapered shank portion with an enlarged boss at a free end thereof, the boss being locatable in a respective aperture in a side wall of said adaptor to prevent the adaptor from disengaging with the nose.

Furthermore, it is also known in the art to use spool and wedge locking assemblies for attaching replaceable earth working implements to a nose of an excavator bucket. Typically, these types of assemblies include a spool and a wedge, each having complimentary ramped surfaces that cause lateral expansion of the assembly as the spool and wedge assembly is contracted, usually by relative axial movement of the wedge with respect to the spool. Whilst generally satisfactory, these types of locking assemblies include a bearing face between the wedge and spool that is orientated at an acute angle to a longitudinal axis of the nose. Due to the large forces experienced by the locking assembly in use, this arrangement is undesirable.

While generally satisfactory for their intended purpose, the abovementioned prior art nose/adaptor (or nose/tooth equivalent) combinations all suffer from one or more shortcomings or disadvantages in terms of inadequate resistance to rotation of an adaptor off a nose under the influence of vertical loads applying a rotational moment to the adaptor, a predisposition to premature wear, difficulties in retention of the adaptors on noses, inadequate locking systems and unduly complicated configurations giving rise to increased fabrication and tooling costs.

OBJECT OF THE INVENTION

It is an object of the invention to overcome or at least alleviate one or more of the above problems and/or provide the consumer with a useful or commercial choice.

In one form, although it need not be the only or indeed the broadest form, the invention resides in a mounting pin assembly for an excavator wear assembly, said mounting pin assembly comprising:

a retaining member configured to be non-rotatably located within a transversely extending mounting aperture of a mounting nose of an excavator, said retaining member having a locating surface and a boss extending from said locating surface;

a locating member, in use, slidably mountable upon said locating surface of said retaining member via a wall aperture of a wear member mounted upon said mounting nose, said wall aperture of said wear member at least partially aligned with said mounting aperture, said locating member having an enlarged portion defined by an outwardly divergent face abutting a wall of said wall aperture of said wear member; and a tensioning member extending between and coupling said boss of said retaining member and said locating member whereby, in use, tension applied to said tensioning member causes relative contraction of said mounting pin assembly such that said locating member is drawn upon said locating surface towards said boss to force said outwardly divergent face to wedgingly engage with said wall of said wall aperture of said wear member to force said wear member into engagement with said mounting nose.

In a further form, the invention resides in a method of removably securing a wear member on to a projecting mounting nose of a digging edge of an excavator, said method comprising the steps of:

non-rotatably mounting a retaining member in a mounting aperture of said mounting nose;

locating on said mounting nose, a wear member having opposed wall apertures partially alignable with said mounting aperture to thereby captively retain said retaining member within said mounting aperture;

slidably mounting on a locating surface of said retaining member through one said opposed wall aperture a locating member having an enlarged portion defined by an outwardly divergent face extending outwardly from said mounting aperture when said locating member is at least partially located therein;

inserting through an opposite wall aperture into said mounting aperture a tensioning member to thereby couple said retaining member and said locating member to form a mounting pin assembly; and tensioning said tensioning member to relatively contact said longitudinal length of said mounting pin assembly, said tensioning member bearing on a boss of said retaining member to draw said locating member towards said boss urging said outwardly divergent face into a wedging contact with a wall of one of said opposed wall apertures of said wear member to thereby draw said wear member on said mounting nose.

In yet a further form, the invention resides in a mounting pin assembly comprising:

a retaining member having a locating surface and a boss extending from said locating surface;

a locating member slidably mountable upon said locating surface of said retaining member and having an enlarged portion defined by an outwardly divergent face; and a tensioning member extending between and coupling said boss of said retaining member and said locating member;

wherein, said tensioning member is configured to cause relative contraction of said mounting pin assembly such that said locating member is drawn upon said locating surface of said retaining member towards said boss when a tensile force is applied to said tensioning member.

Further features of the present invention will become apparent from the following detailed description.

BRIEF DESCRIPTION OF THE DRAWINGS

To assist in understanding the invention and to enable a person skilled in the art to put the invention into practical effect preferred embodiments of the invention will be described by way of example only with reference to the accompanying drawings, wherein.

DETAILED DESCRIPTION OF THE INVENTION

Figure 1:
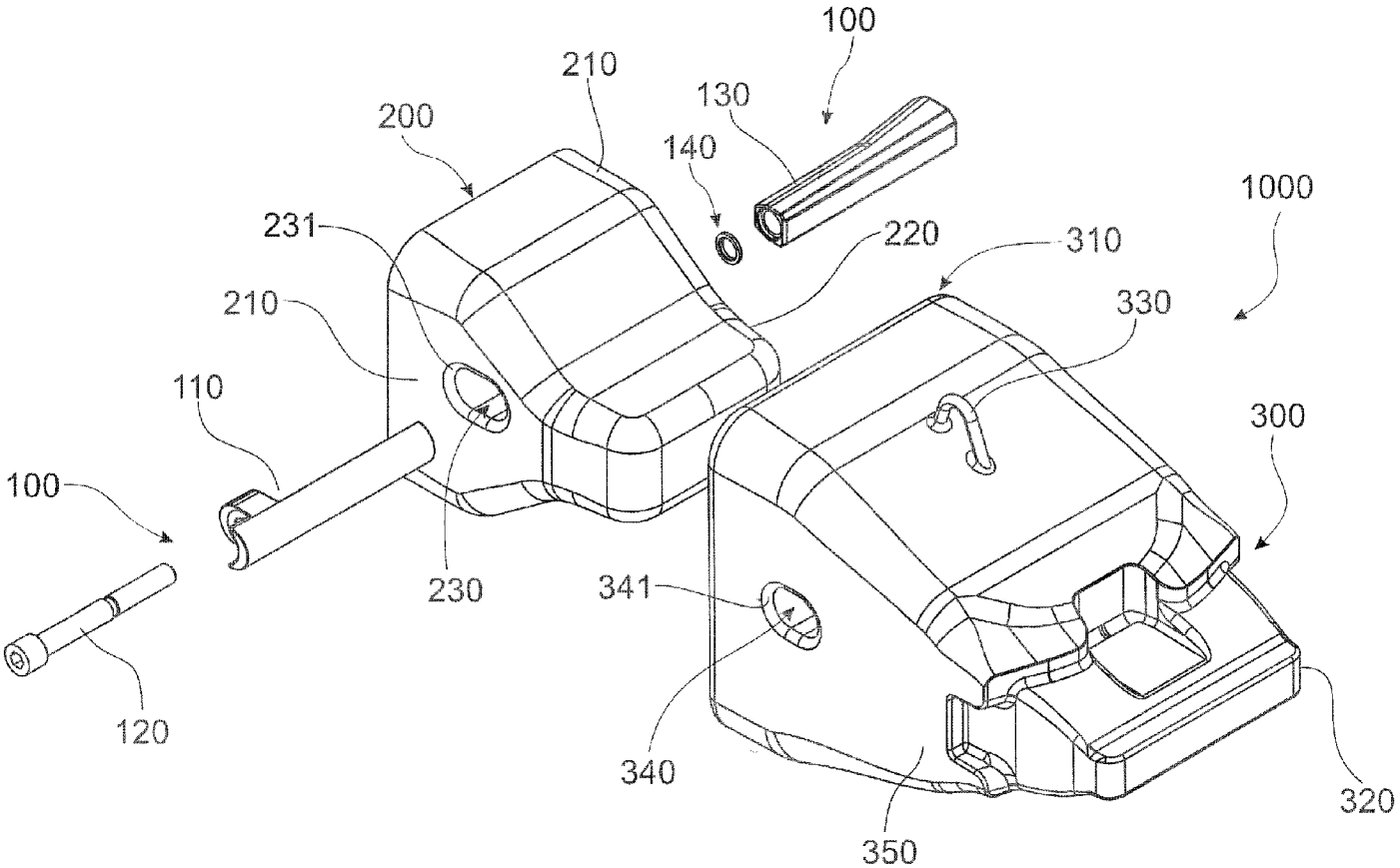
FIG. 1 shows an exploded perspective view of an excavator wear assembly having a mounting pin assembly according to an embodiment of the invention.

FIG. 1 shows an exploded perspective view of an excavator wear assembly 1000 having a mounting pin assembly 100 according to an embodiment of the invention. Excavator wear assembly 1000 further comprises a mounting nose 200 and a wear member in the form of an adaptor 300.

Mounting nose 200 is located upon a lip (not shown) of an excavator bucket. The mounting nose 200 is preferably integrally formed with the lip of the excavator bucket. Optionally, the mounting nose 200 may be formed separately from the lip of the bucket and secured thereto.

In the embodiment, mounting nose 200 has a pair of opposed side walls 210 and a front portion 220. A mounting aperture 230 extends through mounting nose 200 between opposed side walls 210. Suitably, mounting aperture 230 has an oval cross sectional shape. Mounting aperture 230 has an inwardly convergent opening 231 located at either end thereof on respective opposed side walls 210.

Wear member in the form of adaptor 300 has opposed side walls 350 and a mounting portion 320 for reception of digging teeth or the like thereon. A socket cavity 310 is located in the rear portion of adaptor 300. Socket cavity 310 has an internal shape generally complementary to the front portion 220 of mounting nose 200. A hoist loop 330 is located on a top side of adaptor 300 to enable ease of handling by a hoist during attachment and detachment operations.

Side wall apertures 340 extend through respective side walls and each side wall aperture 340 has an inwardly convergent opening 341. Suitably, the cross sectional area of an inner end of each side wall aperture 340 is less than the cross sectional area of mounting aperture 230 of mounting nose 200 as will be discussed in greater detail below.

Alternatively, each side wall aperture 340 may have an inwardly convergent wall extending the entire length thereof.

Excavator wear assembly 1000 further comprises a retaining pin assembly indicated generally by 100 in FIG. 1.

Figure 2:
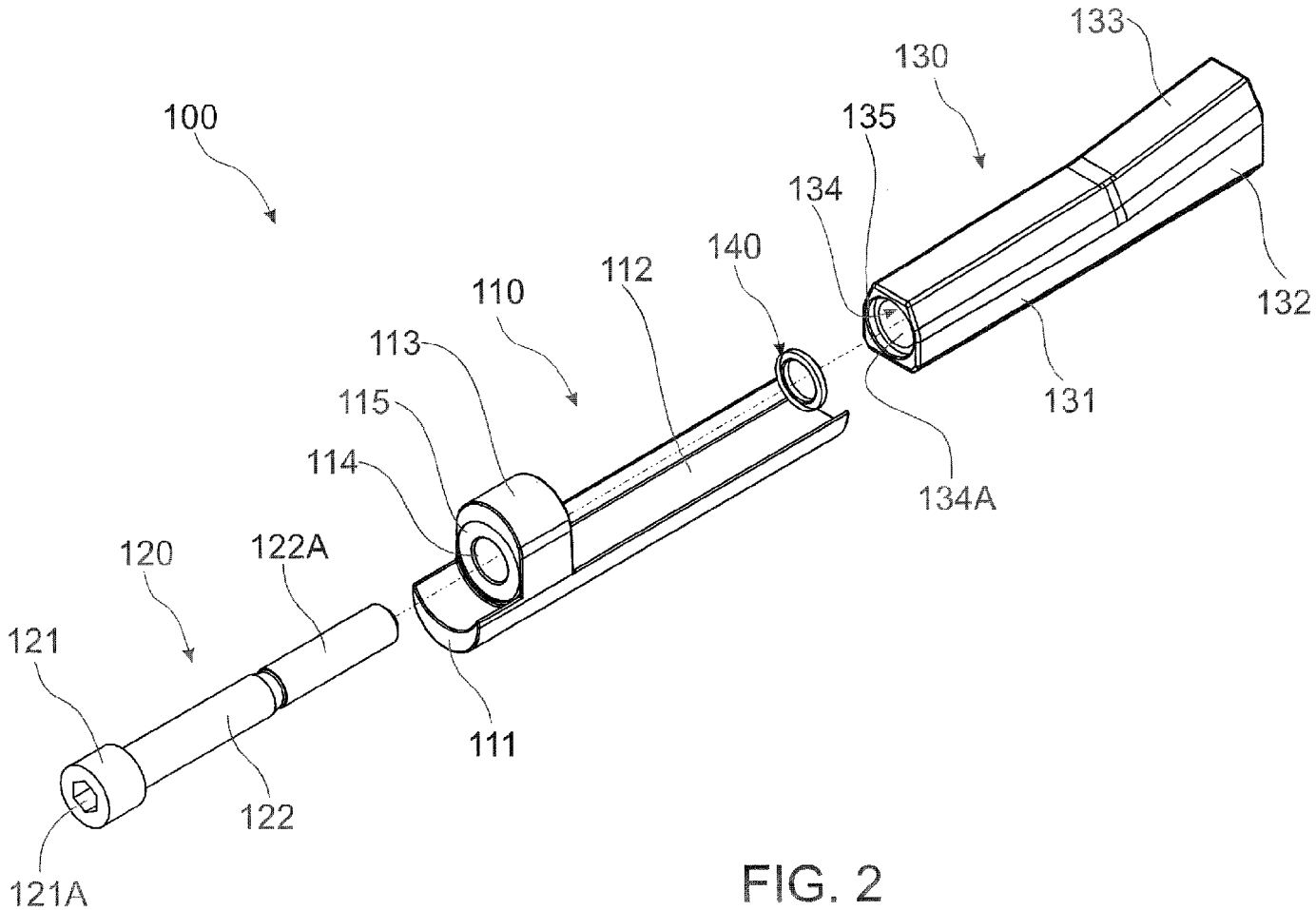
FIG. 2 shows an exploded view of the mounting pin assembly shown in FIG. 1.

FIG. 2 shows an exploded perspective view of retaining pin assembly 100 comprising a retaining member 110, a tensioning member in the form of a bolt 120, a locating member 130 and a washer 140.

Retaining member 110 has a crescent shaped base 111 having a locating surface 112. A boss 113 extends from locating surface 112 such that the cross sectional dimensions of retaining member 110 at the location where boss 113 extends from locating surface 112 is substantially the same as the cross sectional dimensions of mounting aperture 230 of mounting nose 200 as will be discussed in greater detail below.

A guide aperture 114 extends through boss 113 as shown. An annular groove 115 is located upon a face of boss 113 about guide aperture 114.

Tensioning member in the form of bolt 120 has a head portion 121 and a shank 122 extending from head portion 121. A threaded shank 122A extends from shank 122. Shank 122 has a relatively larger outer diameter than the outer diameter of threaded shank 122A with shank 122 having an angled taper to engage washer 140 when in use.

Furthermore, a hexagonally shaped female tensioning recess 121A is located on head portion 121 for engagement with a tensioning tool (not shown) or the like.

Locating member 130 has a body portion 131 and an enlarged portion 132 formed by an outwardly divergent face 133. A blind bore 134 extends longitudinally within locating member 130 within a recess 135 located at an end of locating member 130. Blind bore has a first bore portion 134A (shown in part in FIG. 2) and a threaded bore portion 134B (not shown in FIG. 2). Washer 140 is receivable within recess 135 and is suitably formed from nylon or the like.

Locating member 130 is slidably mountable upon locating surface 112 of retaining member 110 such that blind bore 134 corresponds with guide aperture 114 of retaining member 110 and outwardly divergent face 133 opposes a face of locating member 130 slidably mountable upon locating surface 112. Bolt 120 is receivable through guide aperture 114 and blind bore 134 such that threaded shank 122A is threadably engageable with threaded portion 134B of blind bore 134 as will be discussed in greater detail below.

Figure 3:
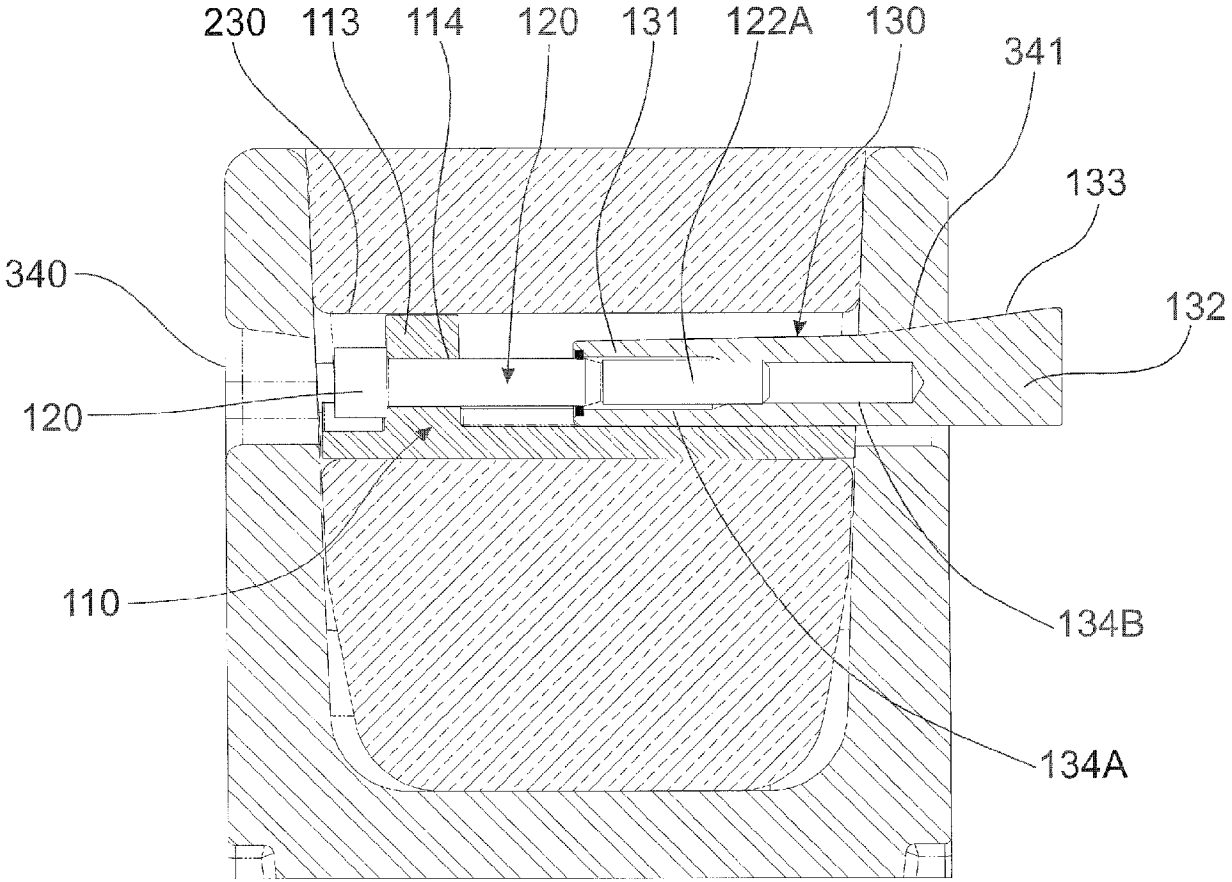
FIG. 3 shows a horizontal sectional view of the excavator wear assembly and the mounting pin assembly of FIG. 1 in an assembled position.

FIG. 3 shows a horizontal sectional view of the excavator wear assembly 1000 in an assembled position. In use, retaining member 110 is non-rotatably located within mounting aperture 230 of mounting nose 200. This non-rotatable location is provided by the cross-sectional dimensions and area of mounting aperture 230 being substantially the same as the cross-sectional dimensions and area of retaining member 110 in the region of boss 113. A person skilled in the art will appreciate that other arrangements will facilitate the non-rotatable location of the retaining member 110 within mounting aperture 230.

The adaptor 300 is then slidably mounted upon mounting nose 200 such that front portion 220 of mounting nose 200 is located within socket cavity 310 of adaptor 300 and each of side wall apertures 340 at least partially align with mounting aperture 230.

As previously discussed, side wall apertures 340 of adaptor 300 have a cross sectional area relatively less than mounting aperture 230 of mounting nose 200. As such, when adaptor 300 is slidably mounted upon mounting nose 200, retaining member 110 is captively retained within mounting aperture 230.

Tensioning member in the form of bolt 120 is then located through at least partially aligned side wall aperture 340 of adaptor 300 and into mounting aperture 230 of mounting nose 200 to penetrate guide aperture 114 of retaining member 110.

Washer 140 is secured within recess 135 of locating member 130 by way of an interference fit and locating member 130 is then inserted through side wall aperture 340 of adaptor 300 opposing side wall aperture 340 through which bolt 120 is located such that locating member 130 is slidably mounted upon locating surface 112 of retaining member 110. In this position, body portion 131 of locating member 130 is generally located wholly within mounting aperture 230 and outwardly divergent face 133 abuts against inwardly convergent opening 341 of side wall aperture 340.

Bolt 120 is then fully inserted through guide aperture 114 of retaining member 110 such that a face of head portion 121 abuts a face of boss 113 within annular groove 115. In this position, a toe of threaded shank 122A is located within blind bore 134 at the transition between first bore portion 134A and threaded bore portion 134B.

A drive member (not shown) of a drive tool (also not shown) is then engaged with hexagonally shaped female tensioning recess 121A of bolt 120 to thereby threadably engage threaded shank 122A of bolt 120 with complimentary threaded bore portion 134B of locating member 130.

As retaining member 110 is captively retained within mounting aperture 230 a face of retaining member 110 bears against an inner face of side wall 350 of adaptor 300 and head portion 121 of bolt 120 bears against a face of boss 113 within annular groove 115 as shank 122A of bolt 120 is threadably engaged with complimentary threaded bore portion 134B of locating member 130.

As such, bolt 120 is placed in tension and mounting pin assembly 100 is relatively contracted in longitudinal length. Furthermore, location member 130 is driven into further slidable engagement with retaining member 110 in a direction of boss 113. As this movement occurs, outwardly divergent face 133 wedgingly engages with inwardly convergent opening 341 of adaptor 300 to thereby urge adaptor 300 into tight engagement with mounting nose 200 as shown in FIG. 3 and thus move the mounting pin assembly 100 to the assembled position.

Furthermore, in the assembled position, shank 122 of bolt 120 is held in blind bore 134 by way of an interference fit by washer 140 to thereby provide resistance to any rotational movement of the bolt 120 that may occur during use.

Furthermore, washer 140 prevents ingress of dirt and fines into blind bore 134 that may cause cementation within blind bore 134.

Furthermore, the plane of contact of the face of locating member 130 on locating surface 112 of retaining member 110 is substantially perpendicular with a longitudinal axis of adaptor 300 and mounting nose 200. This arrangement ensures that this plane of contact is not orientated at an acute angle to the dominant forces applied to the wear assembly 1000.

In order to remove adaptor 300 from mounting nose 200, drive member (not shown) of drive tool (also not shown) is again engaged with hexagonally shaped female tensioning recess 121A of bolt 120 to thereby threadably disengage threaded shank 122A of bolt 120 with complimentary threaded bore portion 134B of locating member 130.

As retaining member 110 is captively retained within mounting aperture 230, the disengagement of threaded shank 122A of bolt 120 from complimentary threaded bore portion 134B of locating member 130 thereby urges locating member 130 out of mounting aperture 230.

Bolt 120 is then removed from guide aperture 114 and adaptor 300 is free to be slidably dismounted from mounting nose 200. Although not prone to wear, retaining member 110 is readily removable from mounting aperture 230 in the event that replacement or maintenance is necessitated.

Figure 4:
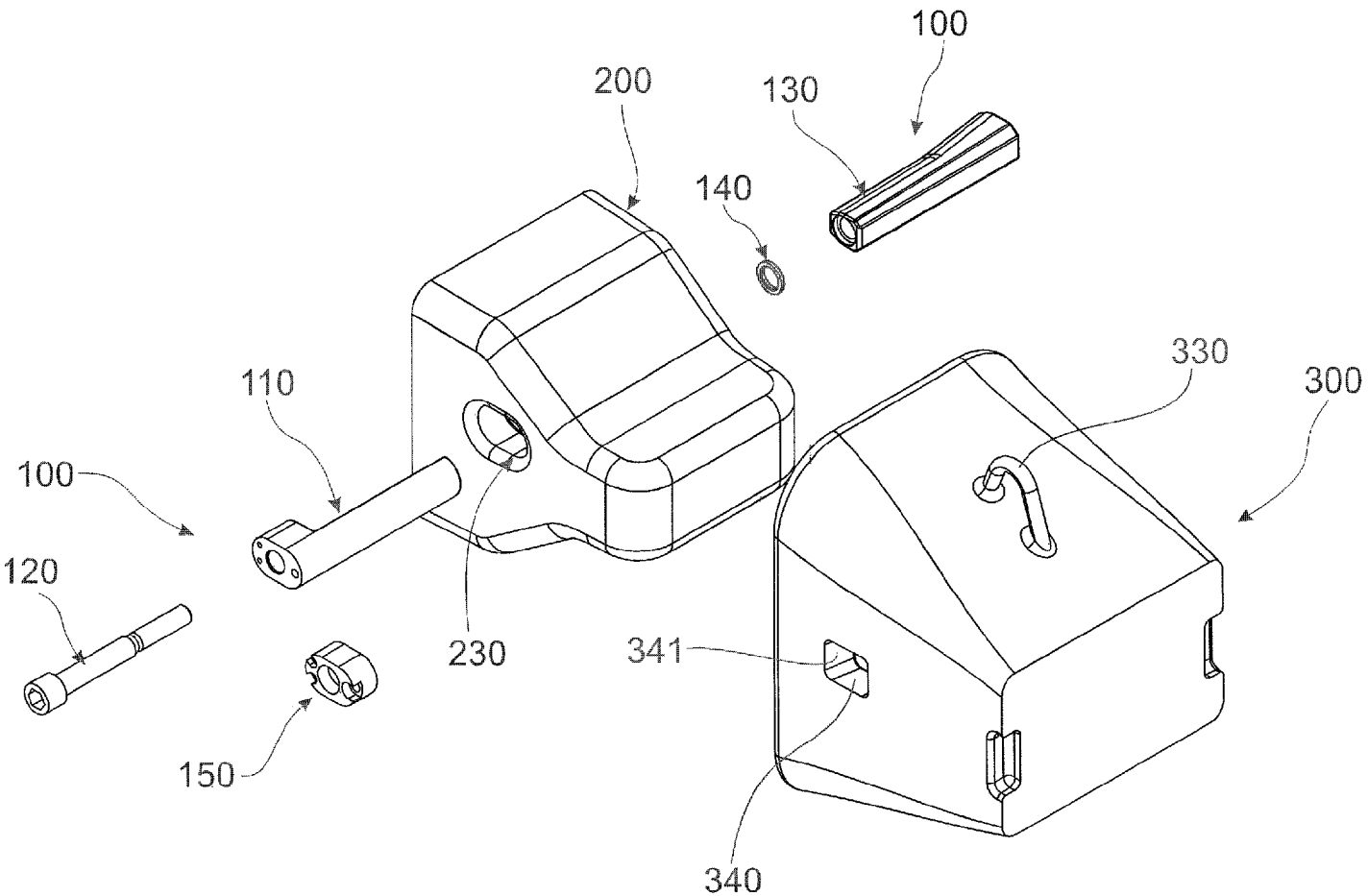
FIG. 4 shows an exploded perspective view of an excavator wear assembly having a mounting pin assembly according to a further embodiment of the invention.

FIG. 4 shows an exploded perspective view of an excavator wear assembly 1000 having a mounting pin assembly, indicated generally by 100, according to a further embodiment of the invention.

As before, the excavator wear assembly 1000 comprises a mounting nose 200 and a wear member in the form of adaptor 300. Adaptor 300 has side wall apertures 340 each having an inwardly convergent opening 341.

Mounting pin assembly 100 comprises a retaining member 110, a tensioning member in the form of bolt 120 and a locating member 130, This embodiment of mounting pin assembly 100 further comprises a jacking member 150.

Figure 5:
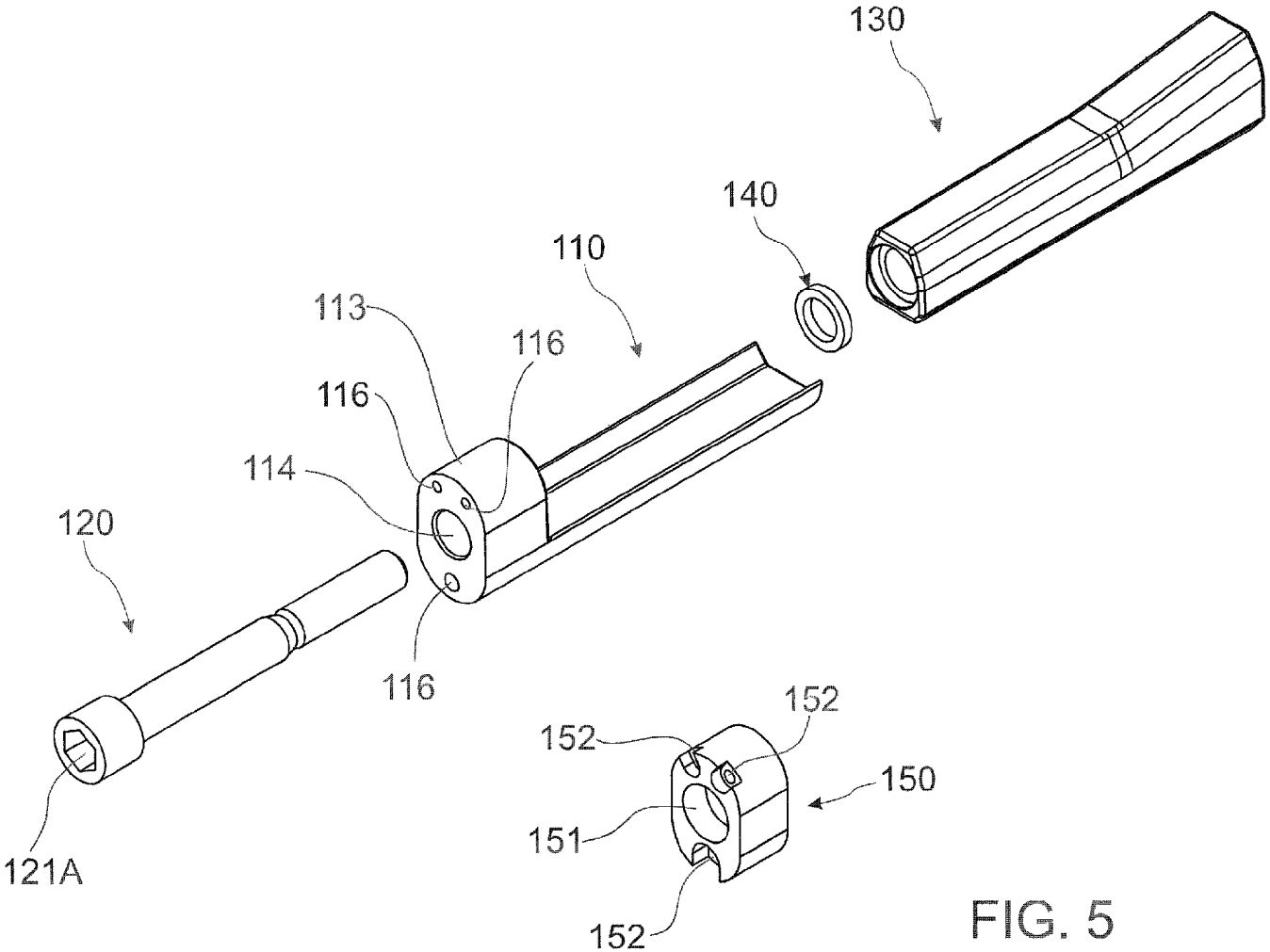
FIG. 5 shows an exploded view of the mounting pin assembly shown in FIG. 4.
Figure 6:
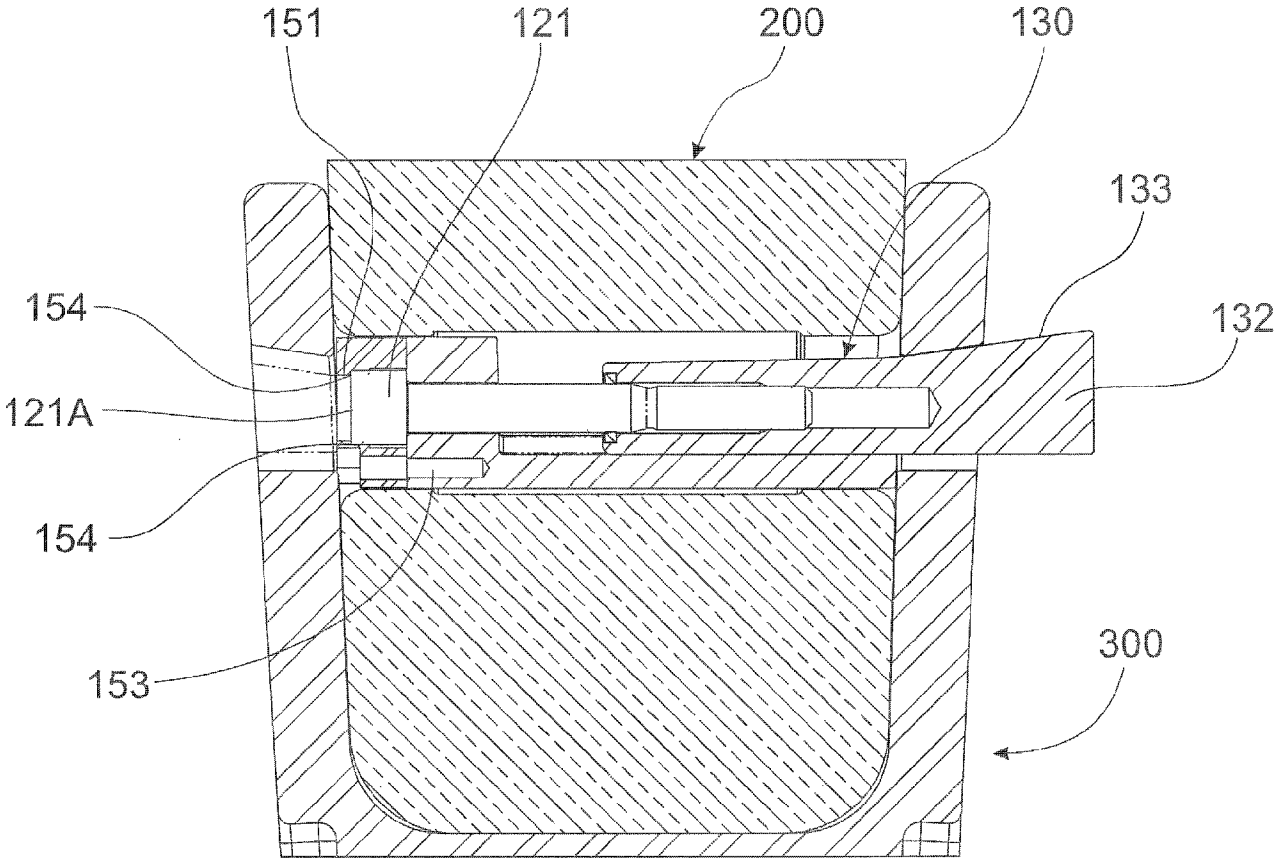
FIG. 6 shows a top sectional view of the excavator wear assembly and the mounting pin assembly of FIG. 4 in an assembled position.

FIG. 5 shows an exploded perspective view of the mounting pin assembly 100 shown in FIG. 4 and FIG. 6 shows a horizontal sectional view of the excavator wear assembly 1000 in an assembled position.

Boss 113 is located at an end of retaining member 110 and has a guide aperture 114 as before. Furthermore, boss 113 has a series of screw threaded apertures 116 as will be discussed in greater detail below.

Jacking member 150 is releasably mountable on a face of boss 113 and has a bolt aperture 151 having a retaining shoulder 154. Furthermore, jacking member 150 has a screw 153 extending through each of spaced mounting apertures 152 extending through bolt retaining member 150.

In use, bolt is located through guide aperture 114 of boss 113 or retaining member 110. Jacking member 150 is then releasably mounted upon a face of boss 113 by way of screws 153 extending through mounting apertures 152 of jacking member 150 and terminating within corresponding screw threaded apertures 116 of boss 113. In this way, retaining shoulder 154 abuts a face of head portion 121 of bolt 120 to thereby captively retain an opposing face of head portion 121 in abutment with a face of boss 113.

The retaining member 110 is then non-rotatably located within mounting aperture 230 of mounting nose 200 as before and adaptor 300 is slidably mounted upon mounting nose 200 to thereby captively retain retaining member 110 within mounting aperture 230 of mounting nose 200.

An outer face of jacking member 150 bears against an inner face of side wall 350 of adaptor 300.

Locating member 130 is then located within mounting aperture 230 as before and bolt 120 is tensioned to relatively contract the length of mounting pin assembly 100 and outwardly divergent face 133 wedgingly engages with inwardly convergent opening 341 of adaptor 300 to thereby urge adaptor 300 into tight engagement with mounting nose 200 as shown in FIG. 6.

It will be apparent to a person skilled in the art that the drive member (not shown) of drive tool (also not shown) is engageable with hexagonally shaped female tensioning recess 121A of bolt 120 through bolt aperture 151.

In order to remove adaptor 300 from mounting nose, drive member (not shown) of drive tool (also not shown) is again engaged with hexagonally shaped female tensioning recess 121A of bolt 120 to thereby threadably disengage threaded shank 122A of bolt 120 with complimentary threaded bore portion 134B of locating member 130.

As a retaining shoulder 154 bears against a face of head portion 121 and an opposing face of head portion 121 is retained in abutment with a face of boss 113 the locating member 130 is driven from within mounting aperture 230 as any opposing force resisting relative longitudinal expansion of mounting pin assembly 100 is borne by inner face of adaptor side wall 350 through abutment with a face of jacking member 150 as previously discussed.

Once locating member 130 is ejected from mounting aperture 230, adaptor 300 is able to be slidably dismounted from mounting nose 200 as before.

Use of jacking member 150 is particularly advantageous in environments where it is likely that locating member 130 may be difficult to extract from mounting aperture 230 due to the ingress and cementation of fines and the like within mounting aperture 230.

It will be readily apparent to a person skilled in the art that the excavator wear assembly, the mounting pin assembly and methods of use thereof in accordance with the invention offer substantial advantages over prior art systems and methods. After a period of time in the field, some degree of wear between the wear member and the nose is inevitable. This wear usually occurs on upper and lower bearing faces of a nose and the front of a nose and the corresponding contact surfaces in the socket cavity of the wear member. When such wear occurs, any slack between the nose and wear adaptor is readily taken up by re-tensioning the bolt of the mounting pin assembly.

Furthermore, any relative movement between the nose and the adaptor generally causes wearing of the nose as the adaptor is generally relatively harder than the nose. As such, by re-tensioning the bolt during use, this relative movement is minimized and hence provides for a longer working life for the wear member and the nose.

Additionally, when casting the nose and the wear member in the form of the adaptor, there will always be manufacturing tolerances such that the manufactured member is not exactly to specification. The mounting pin assembly of the invention accommodates for these tolerances due to the wedging engagement of the pin assembly on the opening of the adaptor to engage the adaptor on the mounting nose. As such, this minimises relative movement, and hence wear, between the adaptor and the nose due to these manufacturing tolerances.

The bolt is readily accessible and the inwardly convergent opening of the adaptor side wall aperture and the outwardly divergent face of the locating member allows for a considerable degree of movement between the nose and wear member along a longitudinal axis with only a relatively small degree of rotation of the bolt of the mounting pin assembly.

The various embodiments of the invention are quick and simple to install and uninstall with readily available tools and do not require severe impacts with a sledge hammer or the like which is a slow and dangerous procedure.

Throughout the specification the aim has been to describe the invention without limiting the invention to any one embodiment or specific collection of features. Persons skilled in the relevant art may realise variations from the specific embodiments that will nonetheless fall within the scope of the invention.

Whilst the invention has been described with reference to the mounting of adaptor 300 to mounting nose 200, it is equally applicable to the mounting of points or digging teeth to adaptors. Generally, teeth have wall apertures extending through opposed top and bottom walls and adaptors have a corresponding mounting aperture. A skilled addressee will appreciate that the mounting pin assembly 100 of the invention may be employed to releasably secure a point or digging tooth to an adaptor.

It will be appreciated that various other changes and modifications may be made to the embodiment described without departing from the spirit and scope of the invention.

The invention claimed is:

1. A mounting pin assembly for an excavator wear assembly, said mounting pin assembly comprising:

a retaining member configured to be non-rotatably located within a transversely extending mounting aperture of a mounting nose of an excavator prior to a wear member being mounted upon said mounting nose, said retaining member having a locating surface and a boss extending from said locating surface;

a locating member slidably mountable upon said locating surface of said retaining member via a wall aperture of said wear member mounted upon said mounting nose, said wall aperture of said wear member at least partially aligned with said mounting aperture, said locating member having an enlarged portion defined by an outwardly divergent face abutting a wall of said wall aperture of said wear member; and a tensioning member extending between and coupling said boss of said retaining member and said locating member whereby tension applied to said tensioning member causes relative contraction of said mounting pin assembly such that said locating member can be drawn upon said locating surface towards said boss to force said outwardly divergent face to wedgingly engage with said wall of said wall aperture of said wear member to force said wear member into engagement with said mounting nose.

2. The mounting pin assembly of claim 1, wherein said wall of said wall aperture of said wear member is in the form of an inwardly convergent opening.

3. The mounting pin assembly of claim 1, wherein a face of said locating member slidably mountable upon said locating surface of said retaining member opposes said outwardly divergent face of said locating member.

4. The mounting assembly of claim 1, wherein a plane formed by contact between a face of said locating member slidably mountable on said locating surface of said retaining member is substantially perpendicular to a longitudinal axis of said mounting nose and said wear member.

5. The mounting pin assembly of claim 1, wherein said retaining member is configured to be captively retained within said mounting aperture of said mounting nose when said wear member is mounted upon said mounting nose.

6. The mounting pin assembly of claim 1, wherein said retaining member has substantially similar cross-sectional dimensions as said mounting aperture at a location where said boss extends from said locating surface.

7. The mounting pin assembly of claim 1, wherein at least one outer face of said retaining member is configured to bear against an inner face of a wall of said wear member when said retaining member is located within said mounting aperture of said mounting nose.

8. The mounting pin assembly of claim 1, wherein said tensioning member is in the form of a bolt extending through a guide aperture formed through said boss, said bolt having a head portion having a bottom face adapted to abut an outer face of said boss.

9. The mounting pin assembly of claim 8, wherein said bolt further includes a threaded shank engagable with a corresponding threaded portion of a blind bore extending longitudinally within said locating member to thereby couple said boss of said retaining member and said locating member.

10. The mounting pin assembly of claim 8 further including a jacking member releasably mountable upon an outer of face of said boss, said jacking member including a retaining shoulder adapted to abut a top face of said head portion of said bolt to thereby captively retain said bottom face of said head portion in abutment with said outer face of said boss.

11. A method of removably securing a wear member on to a projecting mounting nose of a digging edge of an excavator, said method comprising the steps of:

non-rotatably mounting a retaining member in a mounting aperture of said mounting nose prior to said wear member being located upon said mounting nose;

locating on said mounting nose, said wear member having opposed wall apertures partially alignable with said mounting aperture to thereby captively retain said retaining member within said mounting aperture;

slidably mounting on a locating surface of said retaining member through one said opposed wall aperture a locating member having an enlarged portion defined by an outwardly divergent face extending outwardly from said mounting aperture when said locating member is at least partially located therein;

inserting through an opposite wall aperture into said mounting aperture a tensioning member to thereby couple said retaining member and said locating member to form a mounting pin assembly;

tensioning said tensioning member to relatively contact said longitudinal length of said mounting pin assembly, said tensioning member bearing on a boss of said retaining member to draw said locating member towards said boss urging said outwardly divergent face into a wedging contact with a wall of one of said opposed wall apertures of said wear member to thereby draw said wear member on said mounting nose.

12. The method of claim 11, wherein an outer face of said retaining member bears against an inner face of a wall of said wear member when said tensioning member is tensioned.

13. The method of claim 11, wherein said locating member is drawn towards said boss on a locating surface of said retaining member, at least a portion of said locating surface of said retaining member being substantially perpendicular to a longitudinal axis of said mounting nose and said wear member.

14. A mounting pin assembly comprising:

a retaining member configured to be non-rotatably located within a transversely extending mounting aperture of a mounting nose of an excavator prior to a wear member being mounted upon said mounting nose, said retaining member having a locating surface and a boss extending from said locating surface;

a locating member slidably mountable upon said locating surface of said retaining member and having an enlarged portion defined by an outwardly divergent face; and a tensioning member extending between and coupling said boss of said retaining member and said locating member;

wherein, said tensioning member is configured to cause relative contraction of said mounting pin assembly such that said locating member is drawn upon said locating surface of said retaining member towards said boss when a tensile force is applied to said tensioning member.

15. The mounting pin assembly of claim 14, wherein said outwardly divergent face diverges outwardly of said locating surface of said retaining member.

* * * * *